United States Patent [19]

Tominaga

[11] Patent Number: 4,521,016

[45] Date of Patent: Jun. 4, 1985

[54] BALL GAME APPARATUS

[76] Inventor: Yasuhiro Tominaga, 3 Wills Ct., Wyuna Close, Mt. Ommaney, Queensland, Australia, 4074

[21] Appl. No.: 355,575

[22] PCT Filed: Jun. 26, 1981

[86] PCT No.: PCT/AU81/00079

§ 371 Date: Feb. 23, 1982

§ 102(e) Date: Feb. 23, 1982

[87] PCT Pub. No.: WO82/00008

PCT Pub. Date: Jan. 7, 1982

[30] Foreign Application Priority Data

Jun. 26, 1980 [AU] Australia ..... PE4224

[51] Int. Cl.[3] ..... A63B 61/00

[52] U.S. Cl. ..... 273/29 A

[58] Field of Search ..... 273/26 E, 29 R, 29 A, 273/26 EA, 185 C, 196, 206 R, 184 B, 413, 55 B

[56] References Cited

U.S. PATENT DOCUMENTS

| | | | |
|---|---|---|---|
| 1,142,184 | 6/1915 | Lawrence | 273/26 E |
| 1,907,412 | 5/1933 | Zimmer | 273/26 EA |
| 2,839,300 | 6/1958 | Blaha et al. | 273/26 E |
| 3,110,306 | 3/1967 | Burt | 273/26 E |
| 3,442,510 | 6/1969 | Sorenson | 273/26 E |
| 3,593,998 | 7/1971 | Patlyn | 273/29 A |
| 3,804,409 | 4/1974 | Schachner | 273/55 B |
| 3,856,301 | 12/1974 | Davidson | 273/55 B |
| 3,994,494 | 11/1974 | Kelley | 273/26 E |
| 4,068,846 | 1/1978 | Forrest | 273/55 B |

FOREIGN PATENT DOCUMENTS

| | | | |
|---|---|---|---|
| 374404 | 4/1923 | Fed. Rep. of Germany | 273/26 E |
| 2226599 | 1/1973 | Fed. Rep. of Germany | 273/29 A |
| 434143 | 8/1935 | United Kingdom | 273/26 E |

OTHER PUBLICATIONS

Consumer Bulletin, Dec. 1962, p. 23.

*Primary Examiner*—Richard C. Pinkham
*Assistant Examiner*—T. Brown
*Attorney, Agent, or Firm*—Fleit, Jacobson, Cohn & Price

[57] ABSTRACT

An apparatus for practicing tennis or other ball games including a pair of upstanding posts, an elastic cord extending between the posts and a ball connected to the elastic cord. A vertical net is arranged forwardly of the post and in the path of movement of the ball. When the ball is struck, the elastic cord stretches until the ball contacts the net which causes dissipation of at least some of the stored energy in the ball, thus reducing the rate of return of the ball towards the posts.

12 Claims, 10 Drawing Figures

BALL GAME APPARATUS

BACKGROUND OF THE INVENTION

This invention relates to improvements to ball game apparatus and more particularly to apparatus suitable for practising tennis and other ball games.

Basically, tennis practice away from a tennis court is carried out at present by the use of a practice ball anchored to the ground adjacent the player by an elastic cord or by a player hitting a ball against a practice wall. While the latter provides a return shot which closely simulates actual play, it requires a relatively large area and thus it is impractical for most applications. On the other hand, the practice ball does not provide a return simulating actual play as the speed and rate of play of return shots is too high when the ball is hit with a full swing of the racquet. The ball may be slowed down by hitting it upwards, however, in such a case authentic simulation of flight of the tennis ball is not achieved. Various other arrangements are available for practising tennis such as one wherein the ball is suspended by an elastic cord extending between a pair of poles, but such arrangements are not capable of providing practice for all shots which would be encountered in actual play. Furthermore, such known arrangements tend to become uninteresting and boring in use.

SUMMARY OF THE INVENTION

The present invention has been devised to overcome the above disadvantages by providing an improved ball game apparatus which is suitable for practising various ball games and sports such as tennis and which may be adapted for use in a confined area, indoors or outdoors. Other objects and advantages of the invention will become apparent from the following description.

With the above and other objects in view, this invention resides broadly in apparatus for practising ball games or sports, said apparatus including elastic cord means adapted to be connected to a ball, said cord means being elastically stretched subsequent to striking of said ball whereby to cause return of said ball, slack net means disposed forwardly of said ball to dissipate the stored energy of said ball and in the path of movement thereof, and wherein said ball, on striking said slack net means loses most of its stored energy prior to its return.

DESCRIPTION OF THE DRAWINGS

In order that the invention may be more readily understood and put into practical effect, reference will now be made to the accompanying drawings which illustrate a preferred embodiment of the invention and wherein.

DESCRIPTION OF THE PREFERRED EMBODIMENTS

Figure 1:
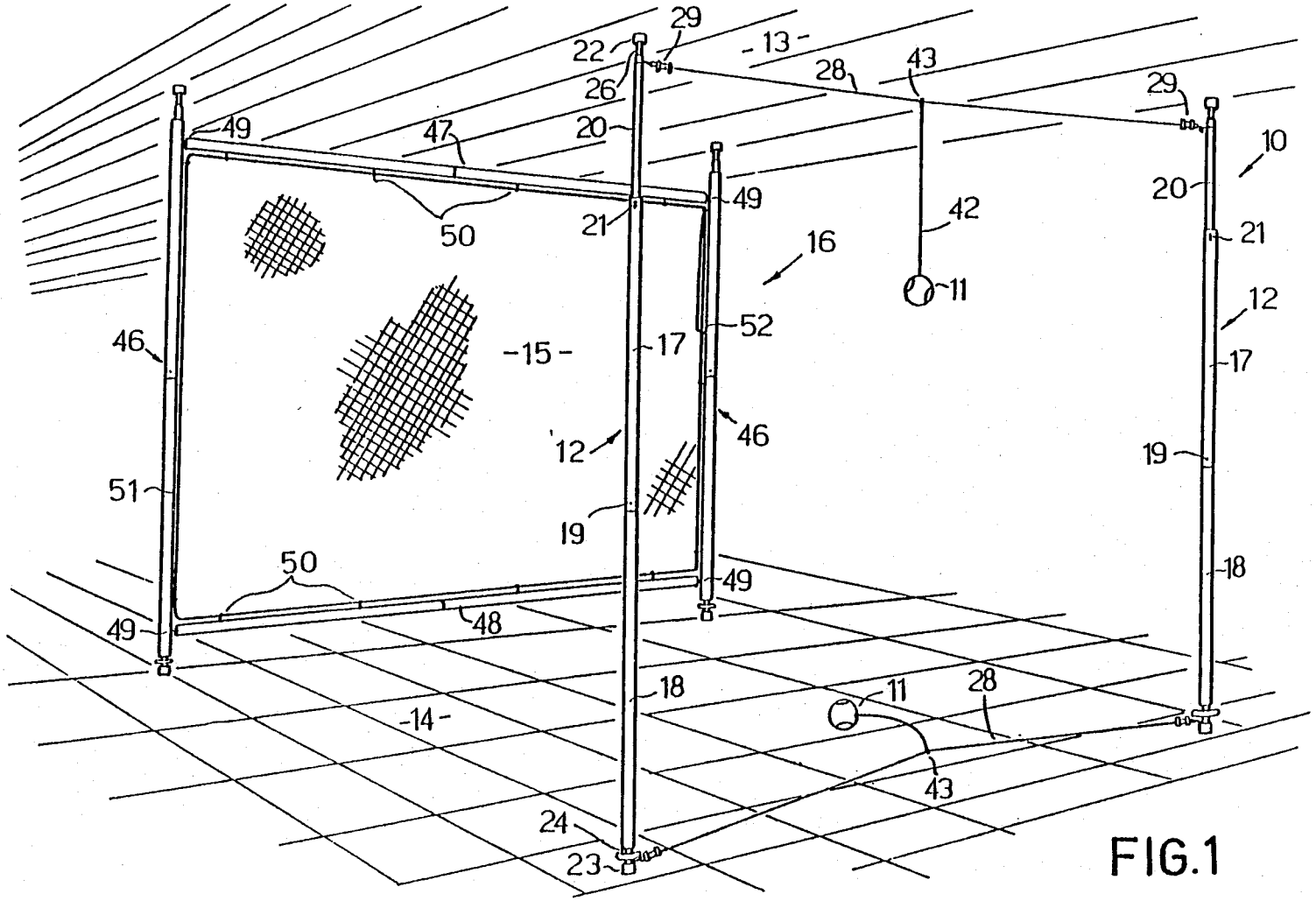
FIG. 1 illustrates ball game apparatus according to the present invention as applied for tennis practice indoors.

Referring to FIG. 1, there is illustrated ball game apparatus 10 according to the present invention which is adapted in particular for practising tennis indoors. To this end, the apparatus includes a tennis ball 11 supported between a pair of upright poles 12 which extend between a ceiling 13 and floor 14 of a room and a slack net 15 which is supported within a rectangular framework 16 and arranged forwardly of the ball 11 and in the path of flight thereof. Each post 12 comprises upper and lower sections 17 and 18 which are releasably interconnected to each other. For this purpose, the lower end of the section 17 is formed as a socket and the upper end of the section 18 as a complimentary spigot to be engageable with the socket. The upper and lower sections 17 and 18 are maintained in an operative attitude by respective spring loaded pins 19 fitted in the lower section 18 which engage in apertures in the upper section. The upper and lower sections 17 and 18 may be simply detached by depressing the pin 19 and pulling the sections apart.

Figure 2A:
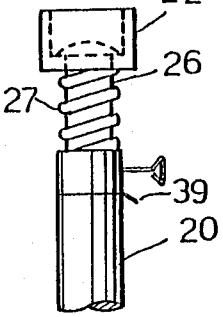
FIGS. 2(*a*) and (*b*), 3(*a*) and (*b*) and FIG. 4 illustrate various components of the apparatus illustrated in FIG. 1.
Figure 2B:
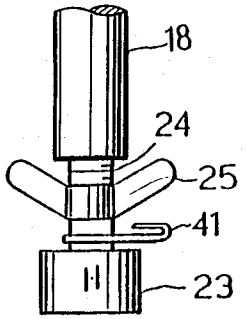

The upper section 17 is provided with a telescopic portion 20 which is arranged to be slidable with respect to the section 17 and locked in any desired position by a clamp arrangement 21 which in this embodiment comprises a screw. Rubber feet 22 and 23 are arranged at the opposite ends of each post 12 with the lower foot 23 being mounted on the end of the section 18 and the upper foot 22 being mounted on the end of the telescopic portion 20 as shown more clearly in FIG. 2. The lower foot 23 is fixed to a threaded stud 24 which is threadedly engaged with the end of the section 18. A wing nut 25 is fixed to the stud 24 so that rotation thereof will cause the foot 23 to move outwardly or inwardly with respect to the post section 18. The upper foot 22 is mounted to the upper end of the telescopic portion 20 by a threaded stud 26 but in this case, the foot 22 is freely movable along the shank of the stud 26. A coil spring 27 surrounds the stud shank and extends between the upper end of the post portion 20 and the foot 22 and acts to bias the foot outwardly away from the end of the telescopic post portion 20.

Thus in use, when it is desired to erect a post 12 between the floor and ceiling of a room, the post sections 17 and 18 are interconnected to each other and the portion 20 telescoped outwardly until the feet 22 and 23 are in contact with the ceiling and floor respectively. The post portion 20 is then locked in this extended position by the clamp 21 and the wing nut 25 at the lower end of the post section 18 is rotated to extend the screw 24 and to force the rubber feet 22 and 23 firmly into engagement with the ceiling and floor respectively, and against the pressure exerted by the spring 27. The spring 27 ensures that the post 12 remains firmly fixed in position. A similar erection operation is then carried out with the other post 12.

The ball 11 may then be suspended from an elastic cord 28 which extends between the upper ends of the posts 12 or alternatively fixed between the lower ends of the posts 12 as illustrated in FIG. 1. Preferably each end of the cord 28 is fixed to the respective ends of the post 12 via clamping assemblies 29 of the type more clearly illustrated in FIGS. 3(*a*) and (*b*).

Figure 3A:
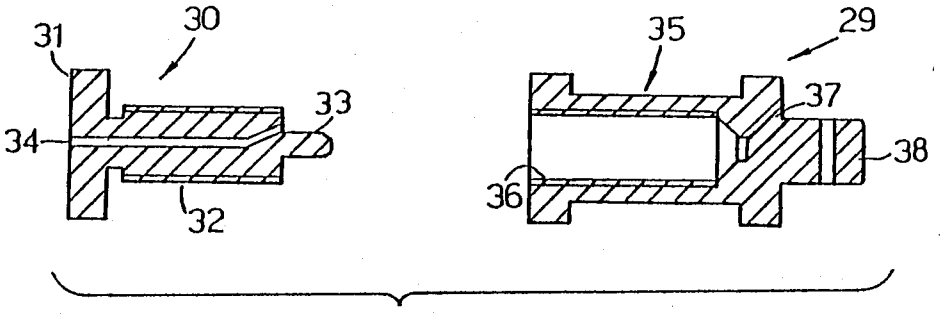
Figure 3B:
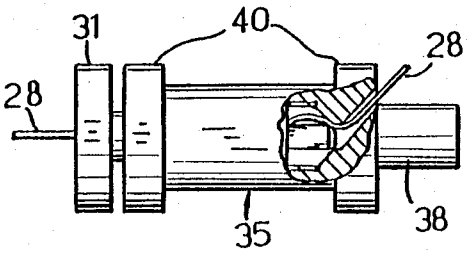

Each clamping assembly 29 includes an apertured bolt member 30 which has an knurled head 31 at one end, a threaded shank 32 and an axially projecting finger 33 extending outwardly of the end of the shank 32. An aperture 34 extends substantially axially from the head 31 of the bolt along the threaded shank 32 and out of the end of the shank 32 at one side of the finger 33. The bolt 30 is adapted to be engaged with a cylindrical socket member 35 and for this purpose, the socket is provided with an internal threaded bore 36 which is engageable with the threaded shank 32. The end of the bore 36 tapers conically into a further aperture 37 which extends outwardly of the end of the socket 35. The end of the elastic cord 28 is fed through the aperture 34 in the bolt member 30 and through the threaded bore 36 and aperture 37 and out of the socket member 35. When it is desired to lock the cord in position, the bolt 30 is engaged with the socket and rotated until the finger 33 squeezes and clamps the cord in place as shown in FIG. 3(*b*). Thus the elastic cord can be tightened or loosened by loosening the bolt 30, moving the cord to the desired position and then re-tightening the bolt 30. Each socket member 35 is provided with an apertured mounting lug 38 which enables the socket to be attached to the telescopic post portion 20 for example via a lug 39 provided at its upper end. Preferably the attachment is by means of a swivel or the like so that twisting of the cord may be eliminated. A pair of spaced annular shoulders 40 are provided on the outer surface of the socket 35 such that the elastic cord may be wound therebetween when it is not in use. Alternatively the clamping assemblies 29 may be attached to the lower ends of the posts 12. For this purpose, a clip 41 is provided about the stud 24 which enables the lug 38 to be attached to the post section 18. (FIG. 2(*b*)).

Figure 4:
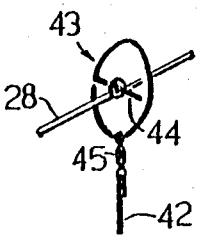

The ball 11 is attached to the elastic cord 28 substantially centrally thereof via a stiff nylon cord 42 and a connector 43 of the type illustrated in FIG. 4. The connector 43 is comprised of a piece of wire bent into a generally circular or oval shape with a bar 44 extending thereacross. The elastic cord 28 is tied about the bar 44 whilst the nylon cord is connected to the outer circumferential portion of the connector by a swivel 45. The connector 43 ensures that the elastic cord 28 tied to the bar 44 is protected to reduce any possibility of breakage at that point. Such an arrangement is important when the ball is connected between the lower ends of the posts 12 and during the playing of ground strokes.

The framework 16 which supports the slack net 15 includes a pair of upstanding posts 46 which are of a similar construction to the posts 12, and upper and lower posts 47 and 48 which extend substantially horizontally between upper and lower portions of the posts 46. Preferably the upper and lower horizontal posts 47 and 48 are formed as two interconnected sections with each section being preferably pivotally interconnected at 49 to the respective side post 46. This ensures that the whole arrangement may be folded for easy transporting purposes. A plurality of eye-bolts 50 are provided around the respective posts such as to support the net 15 to the framework 16. Preferably a perimeter rope 51 is provided around the outer edges of the net 15. One end of the rope is fixed to one of the eye-bolts whilst the opposite end of the rope includes a connector 52 which is engageable with a further portion of the rope 51 and which is movable to fix the slack net 15 to the framework 16 with the rope, desired slack being applied to the perimeter of the net 15.

The dimension of the net is properly wider than that of the framework 16.

A conventional practice ball supported by an elastic cord when hit hard stretches the elastic cord in relation to the force of the hit until the energy is absorbed by the elastic cord, whereupon the ball immediately returns at impractical high speed due to the tension in the cord and, if a vertical tensioned new or hard board is used for bounce, too fast a bounce will occur.

In the present apparatus, the net 15 is placed from the normal position of the ball 11 a distance less than the noraml return position of the ball supported by the cord only so that most of the stored energy in the ball is dissipated by striking the slack net 15 so that the elastic support cord is tensioned to nowhere near the same extent as with the conventional apparatus. Thus the ball when hit hard will return at a slower rate which more closely simulates conventional play, which can be practiced in a narrow space such as a garage for a compact car.

Figure 5:
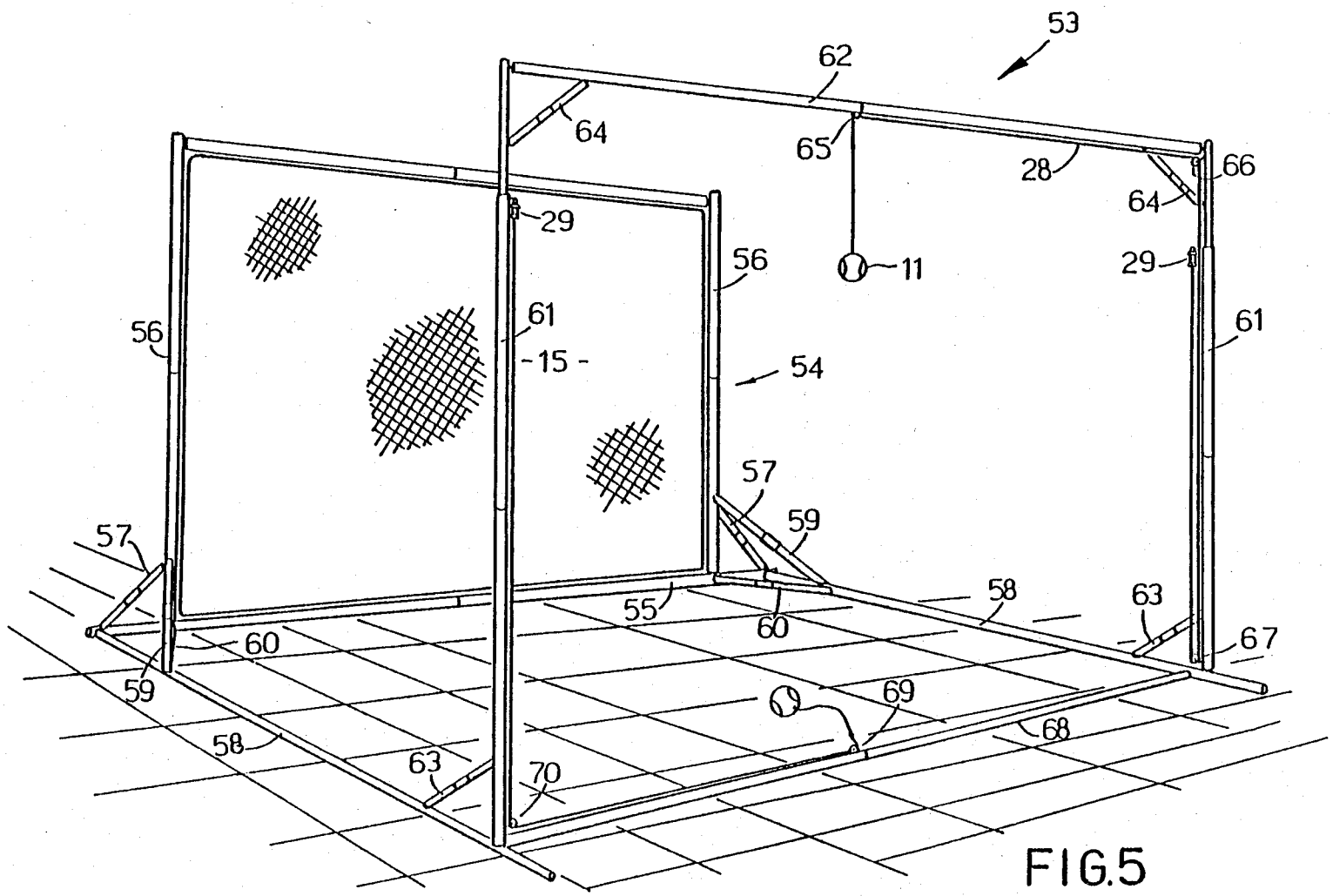
FIG. 5 illustrates ball game apparatus according to the present invention as applied for tennis practice outdoors.

Referring now to FIG. 5, there is illustrated a frame assembly 53 for supporting the net and ball either indoors or outdoors. For this purpose, the frame assembly 53 includes a forward rectangular framework 54 formed of a plurality of interlocking post members which support the net 15 in a substantially vertical plane. The lower horizontal post 55 of the framework 54 extends beyond the respective side posts 56 of the framework in the manner illustrated and support struts or braces 57 extend upwardly from the ends of the post 55 to the side posts 56 to provide the net supporting frame with lateral stability. A pair of substantially parallel post assemblies 58 extend forwardly from the net 15 from the opposite ends of the horizontal posts 55 and further support braces 59 and 60 extend across the corners between the posts 58 and the net supporting framework 54 to support the framework in a substantially vertical attitude. A pair of upstanding posts 61 are arranged at the free ends of the posts 58 and a horizontal post 62 extends between the upper ends of the upstanding posts 61. Further support braces 63 and 64 are also provided to extend across the corners between the posts 58, 61 and 62.

The ball 11 may be attached in a manner similar to that described previously with reference to FIG. 1 at any desired vertical position between the respective posts 61. Alternatively the ball 11 may be suspended from a block 65 carrying a sheave and disposed centrally of the post 62. In this arrangement the elastic cord 28 extends about a further block 66 arranged at the corner between the posts 62 and 61, down about a further block 67 at the lower end of the post 61, and then fixed by a clamp 29 to a position intermediate the ends of the post 61. The extended length of elastic cord 28 in this embodiment ensures a smooth motion of the ball in its return movement. A similar arrangement can be provided for mounting the ball at ground level. For this purpose, a further post 68 is provided to extend between the lower ends of the posts 61 and a block 69 is arranged centrally of the post 68 as shown. The elastic cord then extends along the post 68 about a further block 70 at the lower end of the post 61 to be anchored by a clamp 29 to an intermediate portion of the post.

Figure 6:
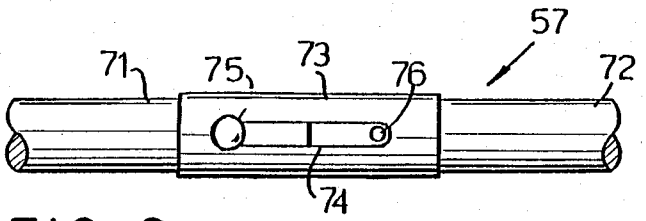
FIG. 6 illustrates a detachable connection arrangement for use in the support braces of the apparatus shown in FIG. 5.

Preferably each support brace 57, 59, 60, 63 and 64 is formed as two interconnected parts, each pivotally mounted at one end to its adjacent post. Preferably the interconnection between the brace parts is of the type shown in FIG. 6. As shown, a support brace, for example 57, is formed in two parts 71 and 72 which in the normal operative position are in abutting contact. A sleeve 73 is provided about the parts 71 and 72 to maintain the parts in an aligned attitude. A longitudinally extending slot 74 is formed in the sleeve 73 and a fastener 75 such as a rivet, passes through the slot 74 and into one part 71. The head of the fastener 75 is larger than the slot 74 so that the sleeve 73 may be slid relative to the fastener 75. A spring loaded pin 76 is provided in the other part 72 and is also engageable with the slot 74. When it is desired to detach the parts 71 and 72, the pin 76 is depressed and the sleeve 73 slid relative to the fastener 75 until it is detached from the part 72. The whole framework can thus be erected or collapsed simply and quickly.

Figure 7B:
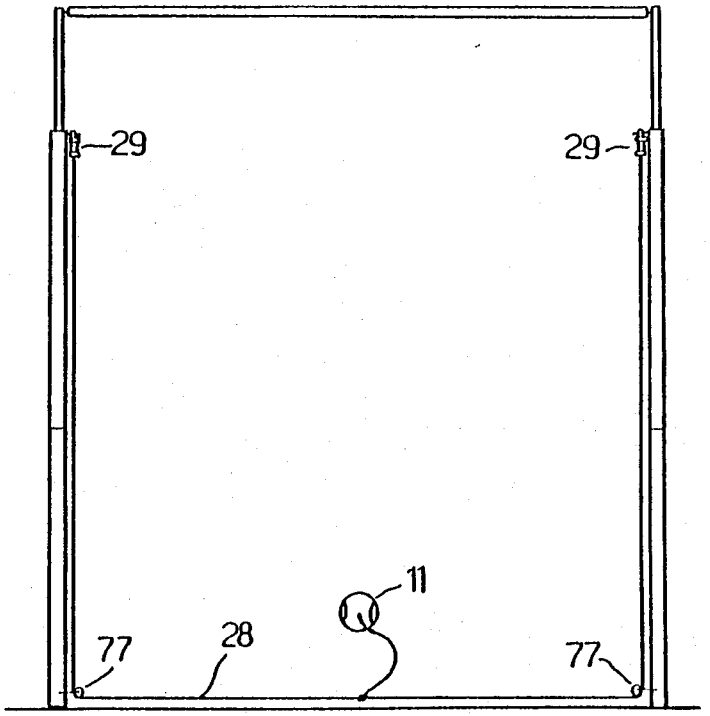
FIGS. 7(*a*) and (*b*) illustrate alternative arrangements for anchoring the ball to the support poles.
Figure 7A:
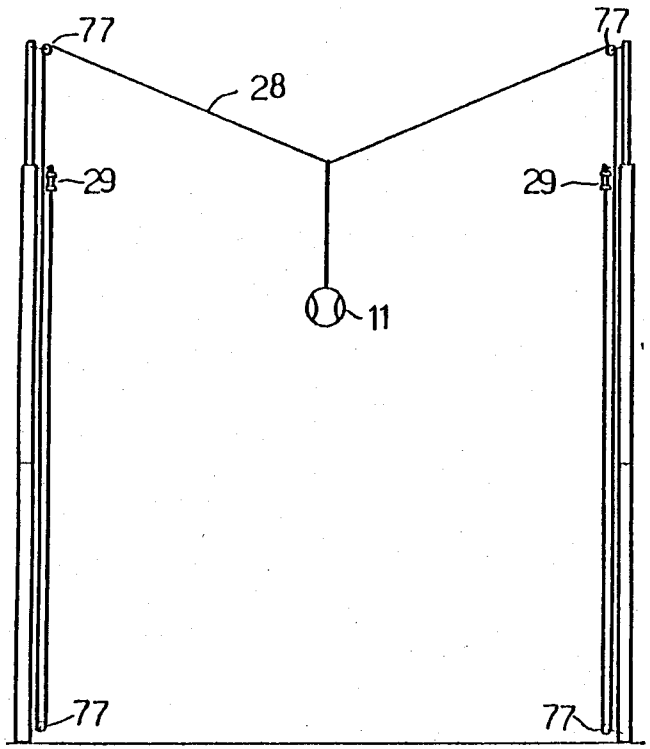

Further arrangements for mounting the ball are shown in FIGS. 7(*a*) and (*b*). In each arrangement the elastic cord 28 is passed about respective sheaves 77 and anchored by respective clamps 29 remotely from the ball 11. This extended length of elastic cord ensures smooth motion of the ball during its forward and return movement. The ball mounting arrangements described above may be used with either embodiment of the invention. However if the ball mounting arrangements illustrated in FIG. 5 and FIG. 7(*b*) are to be used in the FIG. 1 embodiment, it is necessary to provide upper and lower horizontal posts extending between upper and lower ends of the posts 12.

Although the above has been described with reference to tennis practice, the apparatus may be simply adapted for practice of other ball games such as soccer and hand ball.

Whilst the above has been given by way of illustrative embodiment of the present invention, all such variations and modifications as would be apparent to persons skilled in the art are deemed to fall within the broad scope and ambit of the invention as defined by the appended claims.

I claim:

1. Apparatus for practicing a ball game or sports, comprising in combination:

ball means;

elastic cord means connected at one end to said ball means, said cord means being elastically stretched subsequent to striking of said ball means causing return of said ball means;

slack net means having a front side and a rear side, said ball means disposed in front of said slack net means and in the path of movement thereof, for dissipating the stored energy in the ball means and thus reducing the rate of return of the ball means;

a pair of spaced upstanding posts arranged in front of said slack net means, each of the upstanding posts being separated from the slack net means by a predetermined distance;

a substantially horizontal post interconnecting said upstanding posts;

means for anchoring the other end of the elastic cord means; and sheave means arranged substantially centrally of said horizontal post for connecting said ball means to said horizontal post by said cord means extending through said sheave means.

2. Apparatus according to claim 1, wherein said elastic cord means extends between and is fixed to the respective said posts and wherein said ball means is connected to said cord means substantially intermediate said posts.

3. Apparatus according to claim 1, wherein said cord means extends about further sheave means arranged adjacent one end of said horizontal post and extends along the adjacent said upstanding post to be anchored to said upstanding post.

4. Apparatus according to claim 3 and adapted for use indoors, and wherein each said upstanding post includes a pair of feet disposed at opposite ends thereof, each said foot being adapted to be moved into engagement with a respective floor and ceiling of a room.

5. Apparatus according to claim 4, wherein each said upstanding post includes an adjustable telescopic post portion each said portion being adapted to be extended whereby to cause said feet to engage with said floor and ceiling respectively.

6. Apparatus according to claim 1 wherein said net means comprises a net supported about its perimeter by a rectangular framework, said framework being disposed in a substantially vertical plane.

7. Apparatus according to claim 6 and including a rope extending around said net perimeter and wherein said rope may be adjusted to provide the slack state in said net means.

8. Apparatus according to claim 6 or 7, wherein said framework includes a pair of upstanding side posts and respective feet disposed at opposite ends of said side posts, each said foot being adapted to be moved into engagement with a respective floor and ceiling of a room whereby to support said net means in a substantially vertical plane.

9. Apparatus according to claim 1, wherein the length of said cord means between said sheave means and said ball is slightly shorter than said predetermined distance.

10. apparatus according to claim 1, wherein said cord means is made of a stiff nylon cord.

11. An apparatus as claimed in claim 1, wherein said slack net means includes a flexible net, and erecting post means for supporting said flexible net in an erect but slackened condition, and said means for anchoring being located spaced from the front of said flexible net.

12. Apparatus for practicing a ball game or sports, comprising in combination:

ball means;

elastic cord means connected at one end to said ball means, said cord means being elastically stretched subsequent to striking of said ball means causing return of said ball means;

slack net means having a front side and a rear side, said ball means disposed in front of said slack net means and in the path of movement thereof, for dissipating substantially all of the stored energy in the ball means and thus reducing the rate of return of the ball means;

supporting means placed in front of said slack net means, said supporting means being separated from the slack net means by a predetermined distance;

means for anchoring the other end of the elastic cord means; and sheave means arranged on said supporting means for connecting said ball means to said supporting means by said cord means extending through said sheave means.

* * * * *